US006537485B2

(12) United States Patent
Demukai et al.

(10) Patent No.: US 6,537,485 B2
(45) Date of Patent: Mar. 25, 2003

(54) METAL MELTING APPARATUS

(75) Inventors: Noboru Demukai, Gifu (JP); Junichi Tsubokura, Chita (JP)

(73) Assignee: Daido Tokushuko Kabushiki Kaisha, Gifu (JP)

( * ) Notice: Subject to any disclaimer, the term of this patent is extended or adjusted under 35 U.S.C. 154(b) by 0 days.

(21) Appl. No.: 09/866,594

(22) Filed: May 30, 2001

(65) Prior Publication Data

US 2002/0008338 A1 Jan. 24, 2002

(30) Foreign Application Priority Data

May 30, 2000 (JP) ..... 2000-160935

(51) Int. Cl.[7] ..... C22B 9/00
(52) U.S. Cl. ..... 266/208; 373/141
(58) Field of Search ..... 266/208; 373/141; 75/10.14, 10.15, 10.64

(56) References Cited

U.S. PATENT DOCUMENTS 3,056,847 A 10/1962 Junker
3,303,259 A 2/1967 Junker ..... 373/141
4,583,230 A 4/1986 Komada et al.
5,322,543 A * 6/1994 Lazcano-Navarro ..... 75/10.15

FOREIGN PATENT DOCUMENTS

GB 921904 3/1963

* cited by examiner

*Primary Examiner*—Melvyn Andrews
(74) *Attorney, Agent, or Firm*—Bacon & Thomas, PLLC

(57) ABSTRACT

A melting apparatus having a compact structure, of economical equipment cost, enabling to vacuum melting and refining at high productivity. A metal melting apparatus has a structure in which a refractory furnace wall 12 is furnished on an outer circumference thereof with a seal jacket 16 of air tight and non-electrical conductivity, and disposed with vertical water cooling copper pipes 47 along the inner circumference of the seal jacket 16 at predetermined space, and the furnace casing 10 is arranged at the outer part to encircle the furnace casing with an induction heating coil 38, and the furnace casing 10 is secured to a frame 42 by means of the seal jacket 16 for reinforcing the structure. The seal jacket 16 of the furnace casing 10 is fixed to the frame via an upper flange 44 and a lower flange 28.

4 Claims, 3 Drawing Sheets

METAL MELTING APPARATUS

FIELD OF THE INVENTION

The present invention relates to a metal melting furnace suitably used for melting or refining metals, in particular special steel.

BACKGROUND OF THE INVENTION

A demand has recently been arisen to special steel to improve its quality, and a refinement aiming at degasification has been noticed.

As a representative for this degassing refinements, RH vacuum degassing technique has been known, but the RH vacuum degassing facility is large scaled. In addition to equipment cost, since the RH vacuum degassing facility has no special heating means, a problem arises that temperature is lowered during vacuum treating.

As an available vacuum treatment, there is a vacuum induction melting facility, and in general, this vacuum induction melting facility has a structure where the whole of a melting apparatus is completely received in a vacuum chamber, and accordingly the vacuum chamber is large. A facility is large scaled including incidental equipment, so that equipment cost is high.

Since in the vacuum induction melting facility, the induction heating coil is also received in the vacuum chamber, that is, since the induction heating coil is placed within the vacuum, the coil part is easy to discharge, and coil voltage should be 300 V or lower (though improving coil insulation, 600 V or lower). Therefore, in large scaled furnaces, it is difficult to in particular supply large electric power, and a problem is present about productivity.

For securing the productivity, a special electric source of large electric current type is necessary, and it is almost impossible to convert the high voltage type (small current type) to the vacuum induction furnace as maintaining the productivity.

SUMMARY OF THE INVENTION

The metal melting apparatus of the invention has been designed to settle such problems.

The metal melting apparatus of a first aspect of the invention is characterized in that a refractory furnace wall is furnished on an outer circumference thereof with a seal jacket of air tight and non-electrical conductivity, and disposed with vertical water cooling pipes along the inner circumference of the seal jacket at a predetermined distance with respect to one another, and the furnace casing is arranged at the outer part to encircle the furnace casing with an induction heating coil, and the furnace casing is secured to a frame by means of the seal jacket for reinforcing the structure. That is, the metal melting apparatus comprises:

(1) a furnace casing having a refractory furnace wall, (2) an air-tight and non-electrical conductive seal jacket provided on an outer circumference of said refractory furnace wall, (3) vertical water cooling pipes disposed along the inner circumference of said seal jacket, said pipes being arranged apart from one another at a predetermined interval, (4) an induction heating coil arranged to encircle the furnace casing and disposed outside the furnace casing through space, and (5) a frame secured to said seal jacket for supporting said furnace casing through said seal jacket.

The metal melting apparatus of a second aspect of the invention according to the first aspect, is characterized in that the seal jacket of the furnace casing is fixed to the frame at an upper end portion and a lower end portion via an upper flange and a lower flange.

The metal melting apparatus of a third aspect of the invention according to any one of the first or second aspect, is characterized in that the water cooling pipes comprise copper pipes, and are closely disposed in a circumferential direction at short pitch, wherein the distance between central positions of the pipes are within 3D, when the outer diameter or the length of one side of each water cooling copper pipe is D.

The metal melting apparatus of a fourth aspect of the invention according to any one of the second or third aspect, is characterized in that the water cooling pipes are attached and secured at upper and lower ends to the upper and lower flanges.

The metal melting apparatus of a fifth aspect of the invention according to any of the first to fourth aspects, is characterized in that a frame bed is provided, and said frame is rotatably provided to the frame bed together with the furnace casing.

Figure 1:
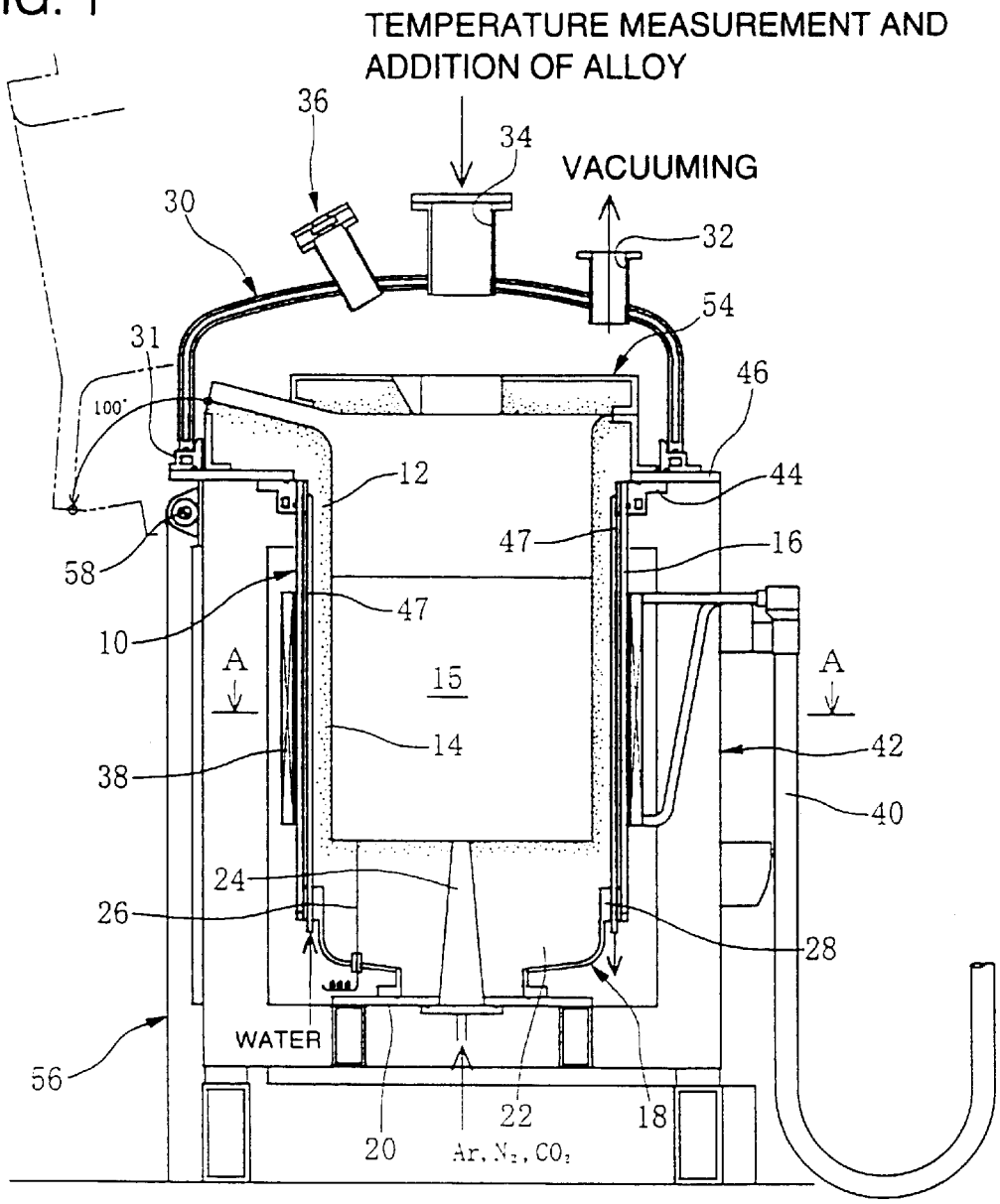
FIG. 1 is a view schematically showing the structure of one exemplified melting apparatus.

Reference Numerals in figures:

10: Furnace casing;

12: refractory furnace wall;

16: seal jacket;

28, 44: flanges;

38: (high frequency) induction heating coil;

42: frame;

47: water cooling copper pipe; and

56: frame

DETAILED DESCRIPTION OF THE INVENTION

As mentioned above, the refractory furnace wall is furnished on the outer circumference thereof with the seal jacket of air tight and non-electrical conductivity so as to air-tightly seal the interior of the furnace casing, and according to the invention, if the vacuum cover is mounted on the furnace casing, the interior space encircled with the furnace casing and the cover can be made a vacuum, thereby enabling to carry out the vacuum treatment for refining such as the special steel.

Since the induction heating coil is placed outside in an atmospheric space, it is possible that, when heating, no discharge is substantially caused in the induction heating coil, and a high voltage is exerted to the induction heating coil, so that the special steel can be melted or refined at excellent productivity.

Further, since the induction coil can be placed in the atmospheric space, the degree of freedom of the source and the coil design is high. In addition, since no especial vacuum chamber is required, the melting apparatus itself can be composed in a simple, compact and economical structure.

Examples of the seal jacket include glass fiber reinforcing resin, for example, a glass fiber-reinforced phenol resin, a glass fiber-reinforced polyimide, phenol resin, polyimide resin or Teflon which do not contain such glass fibers.

Those composed of ceramic materials can be employed, and material qualities can be appropriately selected.

The invention is further characterized in that the seal jacket is fixed to the frame, that is, the furnace casing is fixed to the- frame via the seal jacket, and the furnace casing is reinforced by such frame.

For efficiently heating the molten metal by the induction heating coil, it is effective to make the furnace wall to be as thin as possible. However, being made thin, a mechanical strength of the furnace wall is lowered.

In this regard, in the invention, the furnace casing is reinforced by the frame, whereby the furnace wall can be made much thinner while maintaining the mechanical strength.

Thus, according to the invention, the induction heating coil is placed in the atmospheric air, and in addition to the exertion of high voltage, as the furnace wall can be made thin, so that the molten metal is efficiently heated, whereby the metal can be melted or refined at high efficiency.

If the thickness of the furnace wall is reduced, the heat can be easily transmitted from the molten metal to the seal jacket. In the present invention, vertical water cooling pipes are disposed at predetermined spaces along the inner circumference of the seal jacket so as to prevent increase of the temperature of the seal jacket by the heat from the molten metal.

The water cooling pipe also serves as a stopper of leakage of the molten metal when a lining on the inner face of the refractory wall wears.

Accordingly, the initial thickness of the lining can be safely reduced when execution for the lining, so that a total power efficiency may be heightened and cost for refractory may be suppressed.

The water cooling pipe can be preferably a copper pipe (the third aspect of the invention). In this case, even if pipes contact one another via leakage of the molten metal, no spark occurs is as seen at contacting between turns of multi-layered coils of high frequency.

In the present invention, the seal jacket of the furnace casing may be fixed to the frame at an upper end portion and a lower end portion via an upper flange and a lower flange (the second aspect of the invention).

In such a manner, the furnace casing and the frame can be easily fixed in a simple structure, and the furnace casing can be reinforced by the frame.

In the present invention, the copper pipe is suited as the water cooling pipe (the third aspect of the invention), and in this case, the water cooling copper pipes are closely disposed in a circumferential direction at short pitch, specifically the distance between central positions of the pipes are within 3D, when the outer diameter or the length of one side of each water cooling copper pipe is D, thereby enabling to heighten the cooling efficiency, resulting in effectively controlling the rising temperature of the seal jacket. The present invention has been confirmed to be able to control the temperature of the inner face of the seal jacket to be 300-C or lower.

The water cooling copper pipe may be circular in cross section or square. When the cross section is circular, the outer diameter is D, while a length of one side is D when the cross section is square.

In this case, when the space between pipes is L, L is preferably 2D or lower (more preferably, 0.5D or lower).

In the case of the water cooling copper pipe, the electric power is consumed when heating by the induction heating coil, and the degree of consumption is made larger by more closely disposing pipes.

In this sense, it is desirable that the space between the pipes is 1 mm or larger.

Further, in the invention, the water cooling pipes are attached at upper and lower ends to the upper and lower flanges, and secured by the flanges (the fourth aspect of the invention).

The water cooling pipe is relatively movable at the lower end thereof in the pipe axial direction under the condition that the lower ends of the pipes penetrate through the lower flange.

In such a manner, even if the furnace wall is thermally expanded, the water cooling pipes can be prevented from receiving stress thereon.

A frame bed is provided in the present melting apparatus, and said frame is rotatably provided to this frame bed together with the furnace casing (the fifth aspect of the invention).

EXAMPLE

An example of the present invention will be explained with reference to the attached drawings.

FIG. 1 shows the whole structure of the melting apparatus of the example, and reference numeral 10 designates the furnace casing.

In the furnace casing 10, the refractory wall 12 is treated on the inner face with the lining 14, and on the outer circumference with the air tight and non-electrically conductive seal jacket 16 composed of glass fiber-reinforcing phenol resin. The furnace casing 10 is air-tightly sealed in the interior with the seal jacket 16, a mirror plate 18 made of a later mentioned stainless steel and a plate 20

Herein, the thickness of the lining 14 is very thin as 65 mm in this example.

The furnace casing 10 is equipped at the bottom 22 with a porous plug 24 through which a gas such as Ar, $N_2$ or $CO_2$ may be blown into a molten metal.

At the bottom 22 a run-out sensor 26 is furnished, by which wearing conditions of the lining 14 are continuously monitored. The bottom 22 of the furnace casing 10 is covered on the outer face with the mirror plate 18 of stainless steel. The mirror plate 18 is unitized with a flange (lower flange) 28.

Reference numeral 30 designates a vacuum cover. When vacuum-refining for, e.g., removing hydrogen from steel, the vacuum cover 30 is mounted via a water cooled upper seal 31.

For heightening agitation of the molten metal 15 so as to strengthen refinement, Ar or $N_2$ gas is blown through the porous plug 24, while for decarburizing refinement, $CO_2$ is added thereto.

The vacuum cover 30 is furnished with a vacuum absorption hole 32, a mouth 34 for measuring temperature and adding alloying elements and a window 36 for observing the interior of the furnace.

The furnace casing 10 is arranged to encircle the outer part with an induction heating coil 38.

The induction heating coil 38 is connected with a water cooling cable 40 through which electric power is supplied to the induction heating coil 38.

The furnace casing 10 is equipped on the outer part with the frame 42. On the upper end of the frame 42, the seal jacket 16 of the furnace casing 10 is attached and fixed at the upper portion via a flange (upper flange) 44 and a top plate 46.

The seal jacket 16 of the furnace casing 10 is attached and fixed at the lower end thereof to the lower end of the frame 42 via the flange 28 of the mirror plate 18, that is, the mirror plate 18. By this frame 42, the furnace casing 10 is desirably reinforced.

Figure 2A:
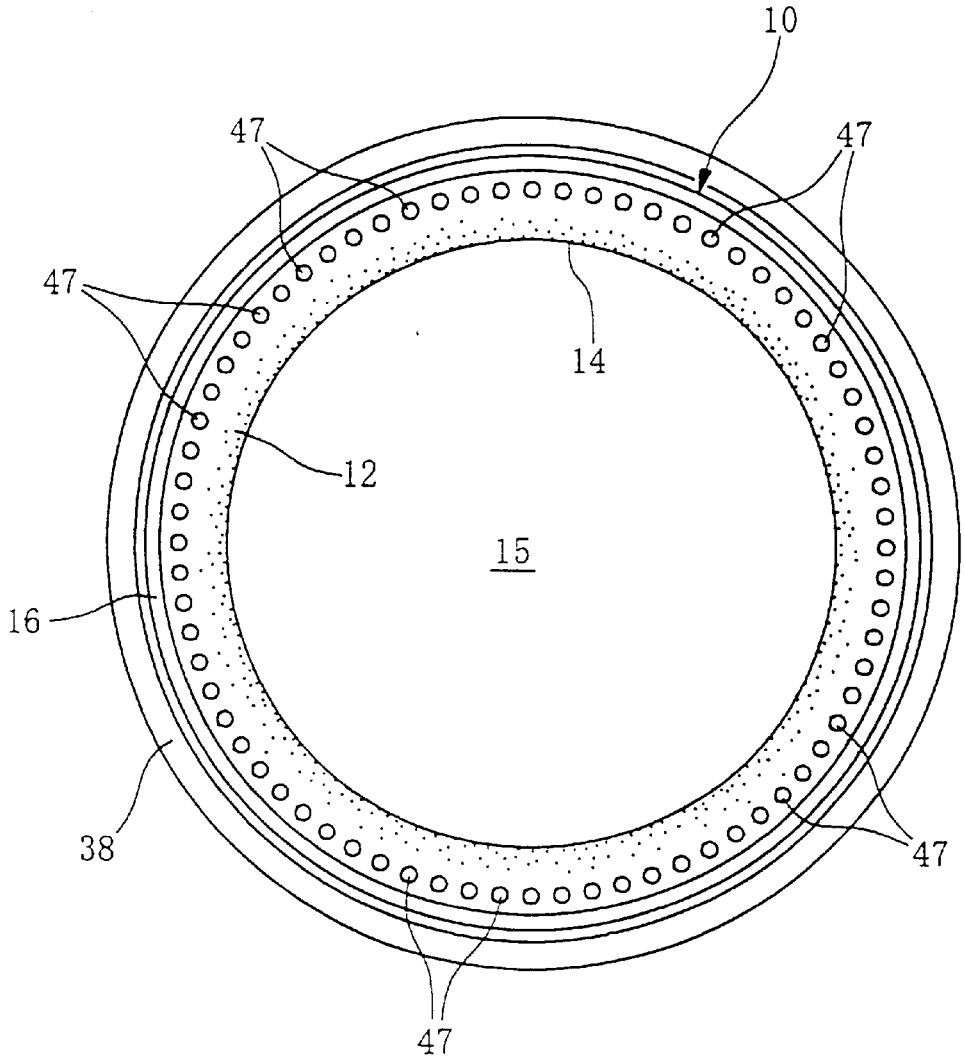
FIG. 2 is a plan view of element parts of the melting apparatus of FIG. 1.
Figure 2B:
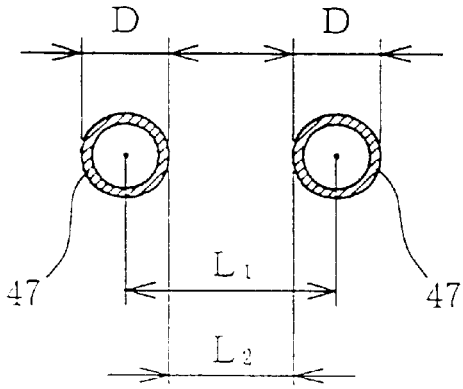

In the inside, as shown in FIG. 2 in detail, vertical water cooling copper pipes 47 are disposed at predetermined pitch $L_1$.

In this example, the pipes of outer diameter D being 20 mm are closely disposed 72 pieces in total at short pitch $L_1$ circumferentailly.

Preferably, the pitch $L_1$ between the water cooling copper pipes 47 and 47 is within 3D when the outer diameter of the water cooling copper pipes is D.

In this disposal, even when the lining 14 was worn 40 mm, the temperature at the inner surface of the seal jacket 16 was 200-C or lower.

It is desirable that the space $L_2$ between the water cooling copper pipes 47 and 47 is 2D or lower, preferably 0.5D or lower. On the other hand, a desirable value of the lower limit is 1 mm.

Figure 3:
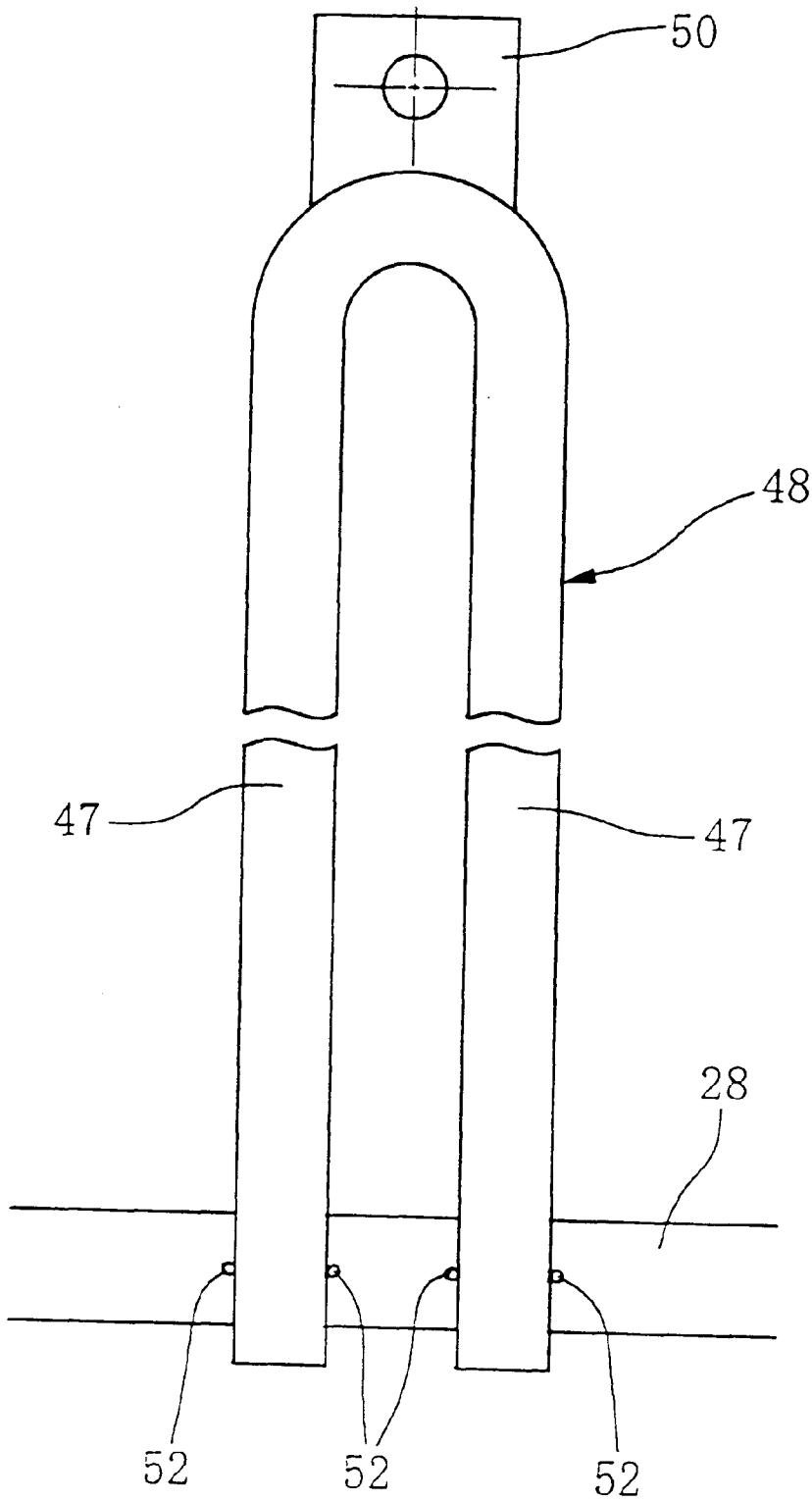
FIG. 3 is a view showing the structure of the water cooling pipe of the exemplified melting apparatus.

In this embodiment, as shown in FIG. 3, two pieces of adjacent water cooling copper pipes 47 are structured to be one piece of U-shaped pipe 48, and its upper end is fixed to the flange 44 by means of a bracket 50.

The lower ends pass through the flange 28 of the mirror plate 18 relatively movably in an axial direction of the pipe. The passing parts are air-tightly sealed with packings 52 to the flange 28.

Since the lower ends of the water cooling copper pipes 47 are relatively movable in the pipe axial direction under the condition of passing through the flange 28, whereby, even if the furnace casing 10 is thermally expanded, the water cooling pipes 47 are desirably prevented from effecting stress thereon.

In FIG. 1, reference numeral 54 designates an inner cover, by which heat dissipation can be restrained during dissolution.

56 designates a frame bed, on which the furnace casing 10 and the whole of the frame 42 are furnished to be tilted (turned or rotated) around a shaft 58.

When tilting the furnace casing 10 for pouring the molten metal, the furnace casing 10 and the frame 42 can be tilted at a predetermined angle (here, 100-) by means of a hydraulic cylinder (not shown).

When tilting, the electric power can be supplied to the induction heating coil 38 through the water cooling cable 40.

EXPERIMENT EXAMPLE

Table 1 shows conditions when melting by the apparatus of the above Example and the apparatus of the Comparative Example of a mode completely receiving the whole melting apparatus into the vacuum chamber. Each melting amount by both was 3 t.

TABLE 1

| | Example | Comparative Example |
|---|---|---|
| Melting amount (t) | 3 | 3 |
| Output of electric source (kW) | 1300 | 800 |
| Coil voltage (V) | 1200 | 600 |
| Frequency (Hz) | 1000 | 500 |
| Volume of vacuum space ($m^3$) | 1 | 4 |
| Melting time (minute) | 75 | 155 |
| Refining time (minute) | 20 | 30 |
| Net unit of power (kWh/t) | 610 | 760 |
| Equipment cost (million yen) | 90 | 150 |

It is apparent from Table 1 that, in the case of the melting apparatus of the Example, the output of the source can be heightened because of no restriction of the coil voltage, and no special vacuum chamber is required for receiving the whole of the melting apparatus, and the volume of the vacuum space can be reduced to around ¼ of the Comparative Example.

As the melting can be performed at high power, the melting time and the refining time can be shortened, and as a result, the net unit of the electric power is small, the operation cost is economical, and the equipment cost can be reduced in comparison with the Comparative Example.

The above mentioned embodiment in detail is one example to the end, and so far as not being off from the subject matter, the invention can be variously modified.

While the invention has been described in detail and with reference to specific embodiments thereof, it will be apparent to one skilled in the art that various changes and modifications can be made therein without departing from the spirit and scope thereof.

This application is based on Japanese patent applications No. 2000-160935 filed on May 30, 2000 the entire contents thereof being hereby incorporated by reference.

What is claimed is:

1. A metal melting apparatus, which comprises:

(1) a furnace casing having a refractory furnace wall, (2) an air-tight and non-electrical conductive seal jacket provided on an outer circumference of said refractory furnace wall, (3) vertical water cooling pipes disposed along the inner circumference of said seal jacket, said pipes being arranged apart from one another at a predetermined interval, (4) an induction heating coil arranged to encircle the furnace casing and disposed outside the furnace casing through space, and (5) a frame secured to said seal jacket for supporting said furnace casing through said seal jacket, wherein the water cooling pipes comprise copper pipes closely disposed in a circumferential direction, the pipes are spaced apart such that the distance between central positions of the pipes is within 3D whereby D is defined as the outer diameter of each water cooling pipe.

2. The metal melting apparatus according to claim 1, wherein the seal jacket of the furnace casing is fixed to the frame at an upper end portion and a lower end portion via an upper flange and a lower flange.

3. The metal melting apparatus according to claim 2, wherein the water cooling pipes are attached and secured at upper and lower ends to the upper and lower flanges.

4. The metal melting apparatus according to any of claims 1 and 3, which further comprises a frame bed and said frame is rotatably provided to the frame bed together with the furnace casing.

* * * * *